United States Patent [19]

Fantetti

[11] 4,197,596

[45] Apr. 15, 1980

[54] COVER FOR TOILET BOWLS

[76] Inventor: Giuseppe Fantetti, Via Zamboni 83, Brescia, Italy

[21] Appl. No.: 950,882

[22] Filed: Oct. 6, 1978

[51] Int. Cl.[2] ..... A47K 13/00; A47K 13/12

[52] U.S. Cl. ..... 4/236; 4/234; 4/240

[58] Field of Search ..... 4/236, 240, 234

[56] References Cited

U.S. PATENT DOCUMENTS

| | | | |
|---|---|---|---|
| 2,202,668 | 5/1940 | Moore | 4/236 |
| 2,283,893 | 5/1942 | Leslie | 4/240 |
| 2,308,284 | 1/1943 | Hoach | 4/240 UX |
| 2,355,378 | 8/1944 | Jacobs | 4/234 |
| 2,382,249 | 8/1945 | Megar | 4/240 |
| 2,477,877 | 8/1949 | Jeffrey | 4/240 |
| 2,742,649 | 4/1956 | Phillips | 4/240 |
| 3,032,777 | 5/1962 | Young | 4/240 |

*Primary Examiner*—Henry K. Artis

[57] ABSTRACT

A cover for a toilet is characterized in that the cover and the seat are movable independently of each other with the cover carrying the seat and being directly pivoted on the toilet fixture without the need for any additional coupling means. The combination of the cover and the seat is coupled to the toilet fixture by means of axially displaceable spring biased pins.

2 Claims, 6 Drawing Figures

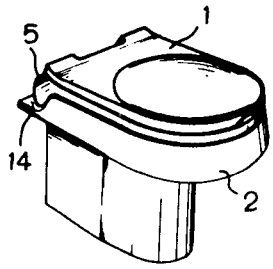
Fig. 1
Fig. 2
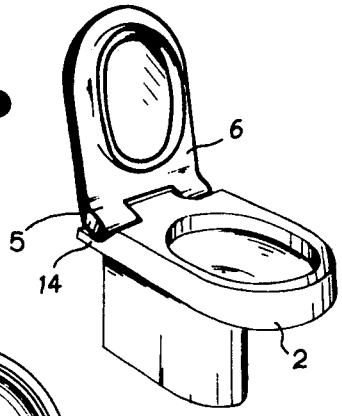
Fig. 4
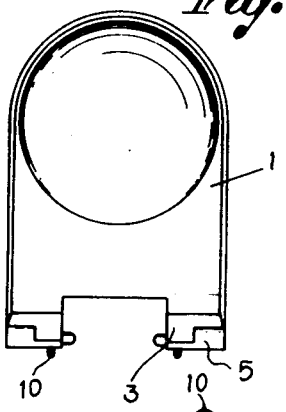
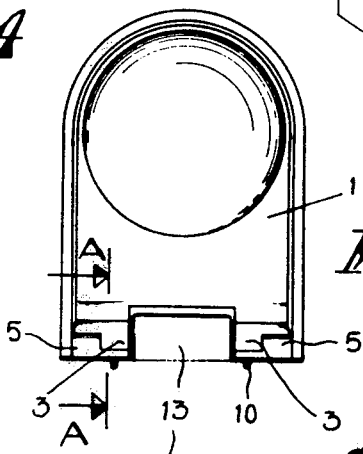
Fig. 3
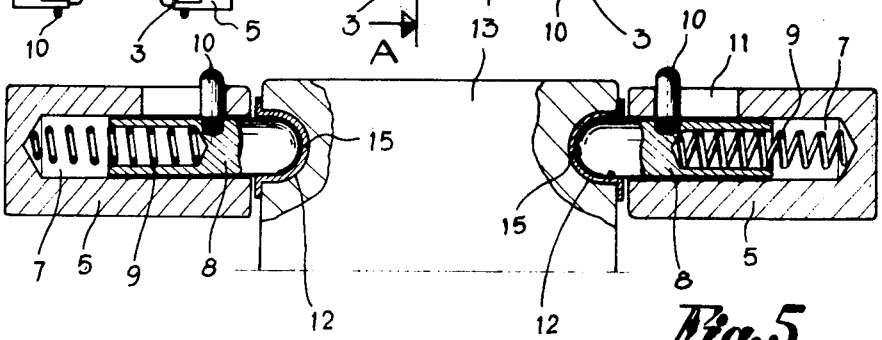
Fig. 5
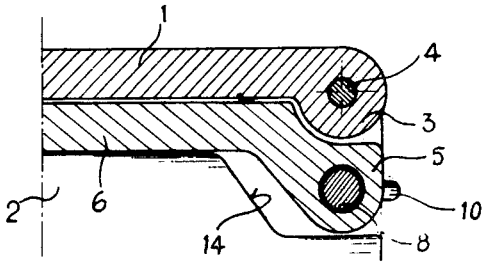
Fig. 6

COVER FOR TOILET BOWLS

This invention relates generally to covers for toilet bowls and more particularly to covers which can be easily and rapidly mounted and taken off.

It is generally known that the cover together with the seat for toilet bowls are fastened to the body of the bowl by means of a pair of bracket supports which must, on the one hand, be fixed to the toilet bowl by means of bolts and, on the other hand, constitute a pivoting pin for moving the cover and the seat.

Equally well known are the difficulties both of centering and mounting the cover on the bracket supports and of dismounting or disassembling the cover and seat as a unit when necessary, partly due to the fact that the operations must normally be carried out under relatively inconvenient conditions and the fastening bolts have a tendency to become rusty and consequently hinder easy and rapid operation.

In contradistinction to this, the object of this invention is to provide a cover with corresponding seat that can easily be fastened to a toilet bowl by means of movable pins with springs similar to door bolts or latches which fit into corresponding holes made in the bowl, so that they themselves constitute pivoting means for moving the seat.

Further details of the invention will become more obvious by the following description made in reference to the attached drawing, drawn up solely by way of illustration, in which;

FIGS. 1 and 2 are perspective views illustrating a complete toilet with seat and cover of this invention lowered and raised, respectively;

FIG. 3 is a top plan view illustrating the cover and seat assembly of this invention mounted on the toilet;

FIG. 4 is a top plan view illsutrating the cover and seat assembly of this invention separate from the toilet bowl;

FIG. 5 is a fragmentary, transverse elevational view partially in section and partially broken away illustrating the mounting of the seat and cover assembly of this invention; and FIG. 6 is a fragmentary, sectional elevational view taken in the direction of arrows A—A in FIG. 3.

Indicated by 1 in the drawings is the cover of a toilet 2 which has on its rear two projections 3 (FIGS. 3, 4 and 5) which pivot, by means of pins 4 (FIG. 6), on two corresponding tabs 5 on the seat 6 in such a way that the cover 1 and the seat 6 can be moved angularly with respect to one another and independently.

Located in the tabs 5 of the seat 6 are two blind holes 7, one on each side, which are open toward one another and in each of which there is housed a pin 8 that is acted upon by a thrust or compression spring 9 designed to hold it pushed toward the outside of the corresponding hole 7. The pin 8 is also provided with a grip lug 10 which is guided in and projects from an elongated slot 11 located radially with respect to the hole 7, the lug 10 constituting means for limiting, in particular, the axial displacement of the pin 8 toward the outside of the aforementioned hole 7.

The seat 6 complete with the cover 1 is installed on the toilet 2 which has two holes 12 located on the opposite sides of a central portion 13 defined by two depressions 14 made in the top of the toilet 2, in which holes 12 there are housed after the insertion of an antifriction cap element 15, the heads of the pins 8 so as to constitute in toto both the means of fastening the seat to the toilet bowl and the pivoting means.

From what has been described above it is obvious that installing and removing the assembly comprising the toilet seat 6 and cover 1, is both easy and rapid, inasmuch as it suffices to actuate the grip lugs 10 with a view to moving the pins 8 with springs 9 in the manner of door bolts in order to engage them and disengage them from the holes 12 in the toilet and accordingly the fastening and, respecitvely dismounting of the toilet assembly.

In the above description there are provided means for mounting of the cover and seat on toilets designed for this purpose, but this does not alter the notion of rapid installation, for example, on an additional member fastened to traditional type toilets.

What is claimed is:

1. A cover for toilets characterized in that the actual cover itself pivots on two parallel tabs located at a distance from one another on the resting seat and in that on the tabs of said seat there are mounted two opposed spring pins which can be moved in the manner of door bolts with a view to engaging the heads thereof in two corresponding holes made in the toilet fixture and constituting the pivot for moving the seat and the cover the tabs on the seat having two blind housings in them, directed and open toward one another, in which, in each of the said housings, there is housed and guided a pin acted upon by a thrust spring suitable for keeping it pushed toward the outside of the said housing, and in which each pin is provided with a gripping lug guided in and projecting from an oblong slot cut radially with respect to the said housing, with said lug determining the limits of axial movement of the said pin said cover bearing the seat and being directly pivoted on the toilet fixture without any intervening means applied to the fixture.

2. A cover for toilet fixtures in accordance with claim 1, characterized in that the cover is pivoted on at least one element provided for that purpose on the toilet fixture.

* * * * *